US009459062B2

(12) United States Patent
Shaskan

(10) Patent No.: US 9,459,062 B2
(45) Date of Patent: Oct. 4, 2016

(54) MAGAZINE CARRIER

(71) Applicant: Torrent Loading Systems, LLC, Lynchburg, VA (US)

(72) Inventor: Paul Joseph Shaskan, Lynchburg, VA (US)

(73) Assignee: Torrent Loading Systems, LLC, Lynchburg, VA (US)

( * ) Notice: Subject to any disclaimer, the term of this patent is extended or adjusted under 35 U.S.C. 154(b) by 0 days.

(21) Appl. No.: 14/573,570

(22) Filed: Dec. 17, 2014

(65) Prior Publication Data

US 2015/0176934 A1 Jun. 25, 2015

Related U.S. Application Data

(60) Provisional application No. 61/918,465, filed on Dec. 19, 2013.

(51) Int. Cl.
*F41A 9/65* (2006.01)
*F42B 39/26* (2006.01)

(52) U.S. Cl.
CPC *F41A 9/65* (2013.01); *F42B 39/26* (2013.01)

(58) Field of Classification Search
CPC ..... F42B 39/002; F42B 39/26; F42B 99/00; F41A 9/65; A47F 1/126
USPC ..... 89/33.1, 45, 1.1; 42/49.02, 90, 106; 221/280
See application file for complete search history.

(56) References Cited

U.S. PATENT DOCUMENTS 162,481 A 4/1875 Lee
1,526,847 A 2/1925 Fritz
2,000,589 A 5/1935 Fuller et al.
2,779,522 A * 1/1957 Puckett ..... F42B 39/002 221/185
2,837,259 A * 6/1958 Blancharrd ..... F42B 39/002 224/199
3,358,881 A * 12/1967 Medina ..... F42B 39/002 221/227

(Continued)

FOREIGN PATENT DOCUMENTS

GB 572628 10/1945
GB 1079193 8/1967

OTHER PUBLICATIONS

Photograph from http://www.google.com/imgres?imgurl=http://i731.photobucket.com/albums/ww316/Tehrawk/PistolReload.jpg&imgrefurl=http://www.boards.ie/vbulletin/showthread.php?t=2055065511&page=34&h=768&w=1024&tbnid=pBtcRkFpwnt6TM&zoom=1&tbnh=194&tbnw=259&usg=_Kslip8rpE7UY-WDGJ_mObr7u6KU=&docid=FTSOQhhY4Mti5M, Posted Jul. 10, 2009.

(Continued)

*Primary Examiner* — Bret Hayes
(74) *Attorney, Agent, or Firm* — John M. Hammond; Patent Innovations LLC

(57) ABSTRACT

A magazine dispenser for loading a magazine into a gun having an opening to receive and hold at least one magazine through an opening. Once at least one magazine is inserted, a flange of the magazine is received in a track provided by a slot region in the magazine dispenser. The magazine then rests on a retention bar disposed in the track which may impede the magazine from being dispensed or support the magazine to be dispensed from the magazine dispenser depending on circumstances.

36 Claims, 14 Drawing Sheets

(56) References Cited

U.S. PATENT DOCUMENTS

| | | | | |
|---|---|---|---|---|
| 3,623,256 | A | 11/1971 | Shiplee | |
| 3,883,041 | A | 5/1975 | Olson | |
| 4,484,404 | A | 11/1984 | Johnson | |
| 4,685,600 | A | 8/1987 | Reuschel | |
| 4,799,323 | A | 1/1989 | Musgrave | |
| 4,940,135 | A | 7/1990 | Hall | |
| 4,947,571 | A | 8/1990 | Kitzmann | |
| 5,127,565 | A | 7/1992 | Grant | |
| 5,131,563 | A * | 7/1992 | Yablans | B65G 1/07 221/124 |
| 5,676,241 | A | 10/1997 | Degoix et al. | |
| 6,000,589 | A | 12/1999 | Burdine | |
| 6,202,908 | B1 | 3/2001 | Groover | |
| 6,327,805 | B1 | 12/2001 | Clifton, Jr. | |
| 6,668,479 | B1 | 12/2003 | Obong | |
| 6,688,504 | B1 * | 2/2004 | Kirkaldy | A45F 5/021 224/196 |
| 7,364,057 | B2 | 4/2008 | Carroll | |
| 8,104,640 | B2 | 1/2012 | Selvetti | |
| 8,944,283 | B2 * | 2/2015 | Shiell | F42B 39/02 221/261 |
| 2003/0200693 | A1 | 10/2003 | Seifert | |
| 2005/0189371 | A1 * | 9/2005 | Harvey | F41A 9/64 221/226 |
| 2010/0327006 | A1 * | 12/2010 | Campo | F42B 39/26 221/185 |
| 2013/0248566 | A1 * | 9/2013 | Solomon | A45F 5/02 224/191 |

OTHER PUBLICATIONS

Photograph from http://www.google.com/imgres?imgurl=http://stwww.recoilweb.com/wp-content/uploads/2015/01/Bottrell-Reload-with-one-hand-300×200.jpg&imgrefurl=http://www.recoilweb.com/battle-brotherhood-vodka-38051.html&h=200&w=300&tbnid=__XsoGVU3pd8kiM&zoom=1&tbnh=160&tbnw=240&usg=__NEMEAv241425y9I3IEC7HdYoVYI=&docid=OP6wMZI7DG4XmM, Posted Jan. 14, 2014.

Rob Curtis, "Military Times GearScout's Best of SHOT Show 2015—Pistol Accessories: Bobcat Tactical Solutions One Arm Bandit", Retrieved from http://www.militarytimes.com/story/life/2015/02/17/military-times-gearscout-blog-best-of-shot-show-2015/22597431/, Feb. 19, 2015.

West Carr, "One Handded Reloading System With the ARMS", YouTube Video and ScreenShot retrieved from https://www.youtube.com/watch?v=zUQ5AieMIW8, Published Jun. 4, 2013.

Pouches—Garrett Industries: GI SLMC—Spring Loaded Pistol Magazine Carrier, Retrieved from http://milspecmonkey.com/index.php/weargear/pouches/210-garrett-industries-gi-slmc-spring-loaded-pistol-magazine-carrier, Created Oct. 12, 2008.

PCT Application No. US2014/070787 International Search Report issued Apr. 20, 2015. EFS file name 20160419__14-573570__IDS__NPL__Cite1.pdf.

PCT Application No. US2014/070787 Written Opinion issued Apr. 20, 2015. EFS file name 20160419__14-573570__IDS__NPL__Cite2.pdf.

* cited by examiner

MAGAZINE CARRIER

CROSS-REFERENCE TO RELATED APPLICATIONS

This application claims the benefit of U.S. Provisional Application No. 61/918,465, filed Dec. 19, 2013, entitled to Magazine Carrier, which is hereby incorporated by reference in its entirety.

The present disclosure relates to an apparatus for dispensing a magazine. The magazine may be inserted into the apparatus and be dispensed, and loaded into a gun.

BRIEF DESCRIPTION OF THE DRAWINGS

The present disclosure will become apparent and more readily appreciated from the following description of embodiments, taken in conjunction with the accompanying drawings, of which.

DETAILED DESCRIPTION OF EMBODIMENTS

Figure 1:
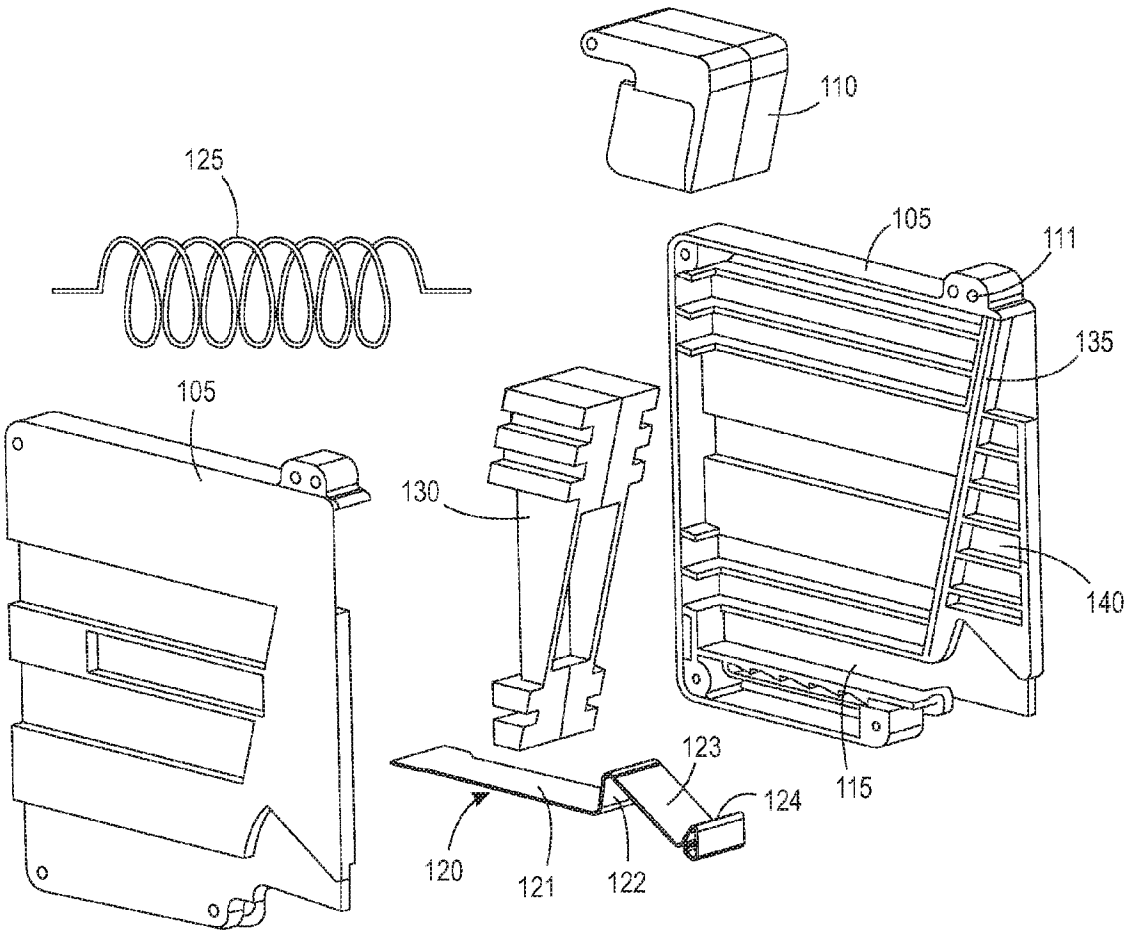
FIG. 1 is an exploded view of a magazine dispenser.

Reference will now be made in detail to embodiments of the present disclosure, examples of which are illustrated in the accompanying drawings, wherein like reference numerals refer to like elements throughout.

Referring to FIG. 1, the magazine dispenser may include housing 105, cap 110, slot region 115, retention bar 120, spring 125, and plunger 130. In accordance with at least one embodiment, slot region 115, retention bar 120, spring 125, and plunger 130 may be disposed inside of housing 105, and cap 110 may be coupled to an exterior of housing 105. Furthermore, housing 105 may be disassembled to expose its internals.

Figure 2:
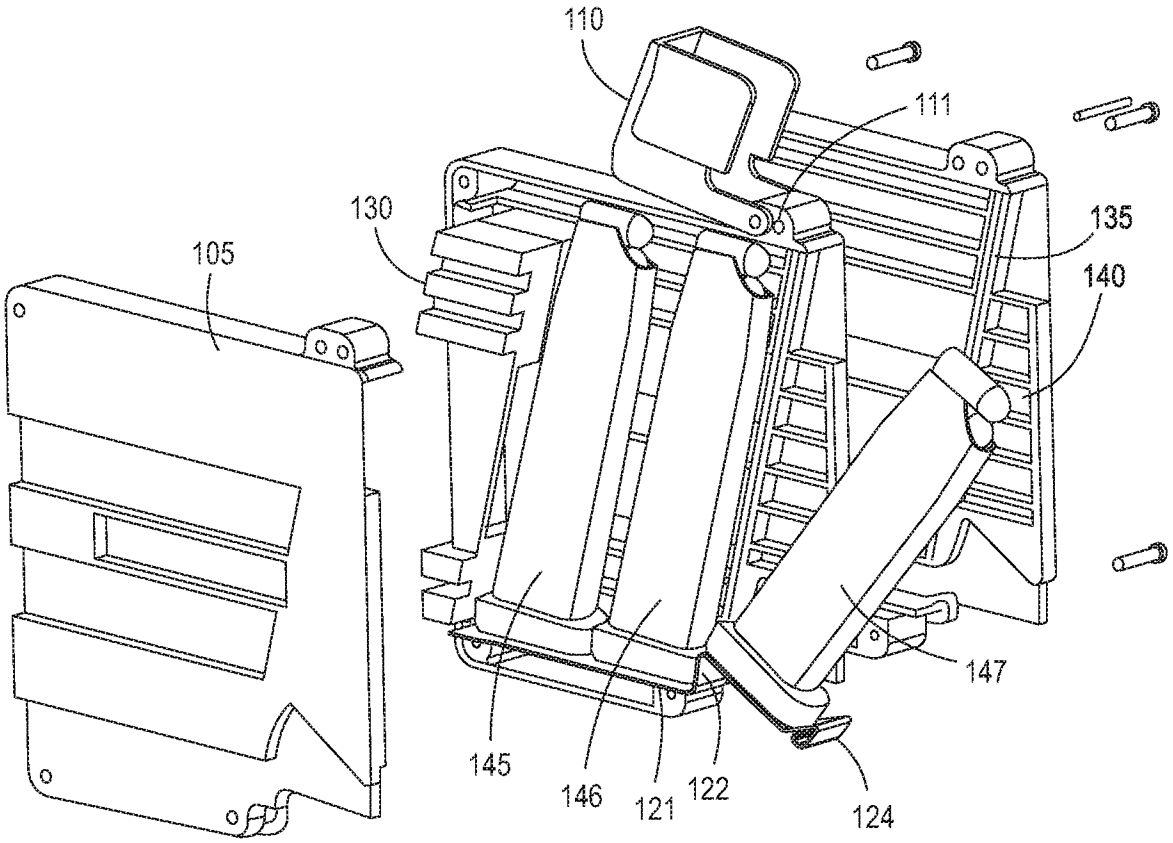
FIG. 2 is an exploded perspective view of a magazine dispenser.

As shown in FIG. 2, housing 105 may have an opening configured to receive at least one magazine. Housing 105 may include brushes 135 near the opening to prevent external dust from coming inside, and grooves 140 near the opening to provide a grip for a magazine which is about to be dispensed from housing 105. In accordance with at least one embodiment, housing 105 may be made from materials suitable for making military/law enforcement applications. For example, housing 105 may be made from Nylon 12 for military applications or Nylon 6 for law enforcement applications. In accordance with another embodiment, housing 105 may be made from plastic materials, such as carbon plastic. The present disclosure, however, is not limited thereto.

As shown in FIG. 2, housing 105 may receive and hold three magazines. First magazine 145 may be farthest away from the opening of housing 105, third magazine 147 may be closest to the opening of housing 105, and second magazine 146 may rest between first magazine 145 and third magazine 147.

Figure 3:
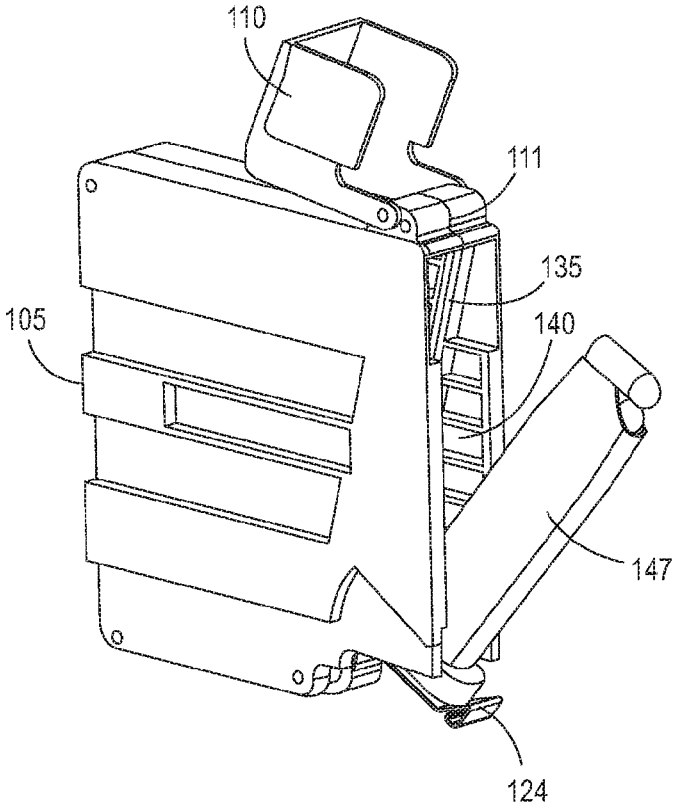
FIG. 3 is a perspective view of a magazine dispenser with a cap opened.

As shown in FIG. 3, cap 110 may be pivotally coupled to the exterior of housing 105 near the opening. Cap 110 may be pivotally coupled to an exterior of housing 105 via securing means 111. For example, securing means 111 may include a screw, a pin, a spring, a knob, and a notch. The present disclosure, however, is not limited thereto.

Figure 4A:
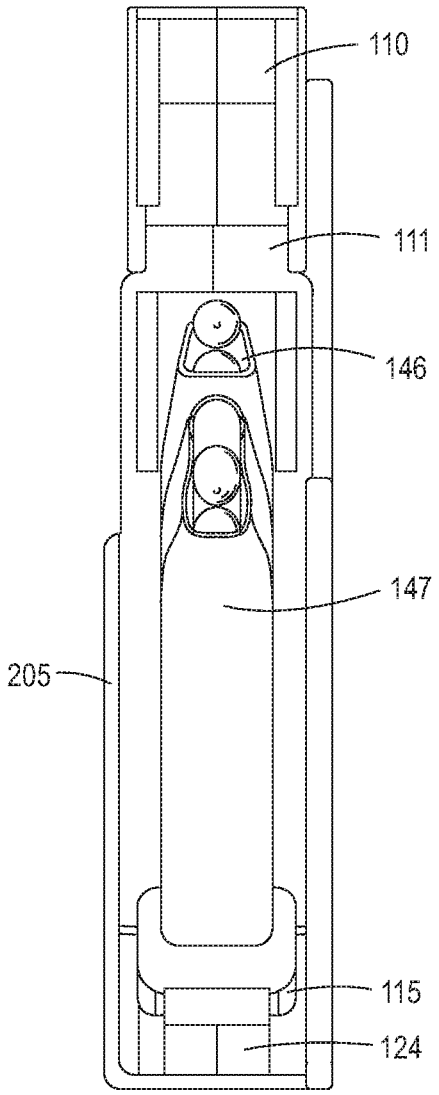
FIGS. 4A and 4B illustrates open and closed positions of a cap.
Figure 4B:
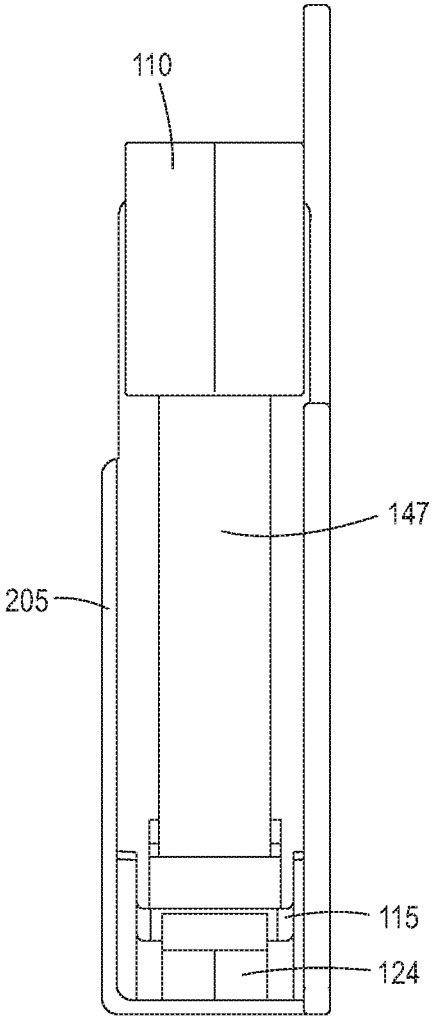

Cap 110 may have open and closed positions. As shown in FIG. 4A, cap 110 may be opened to expose magazines inserted in housing 105. When cap 110 is opened, the magazines inserted in housing 105 may be dispensed. Alternately, cap 110 may be closed to secure magazines inserted in housing 105, as shown in FIG. 4B. When cap 110 is closed, the magazines inserted in housing 105 may be secured from being accidentally dispensed from housing 105.

Figure 5:
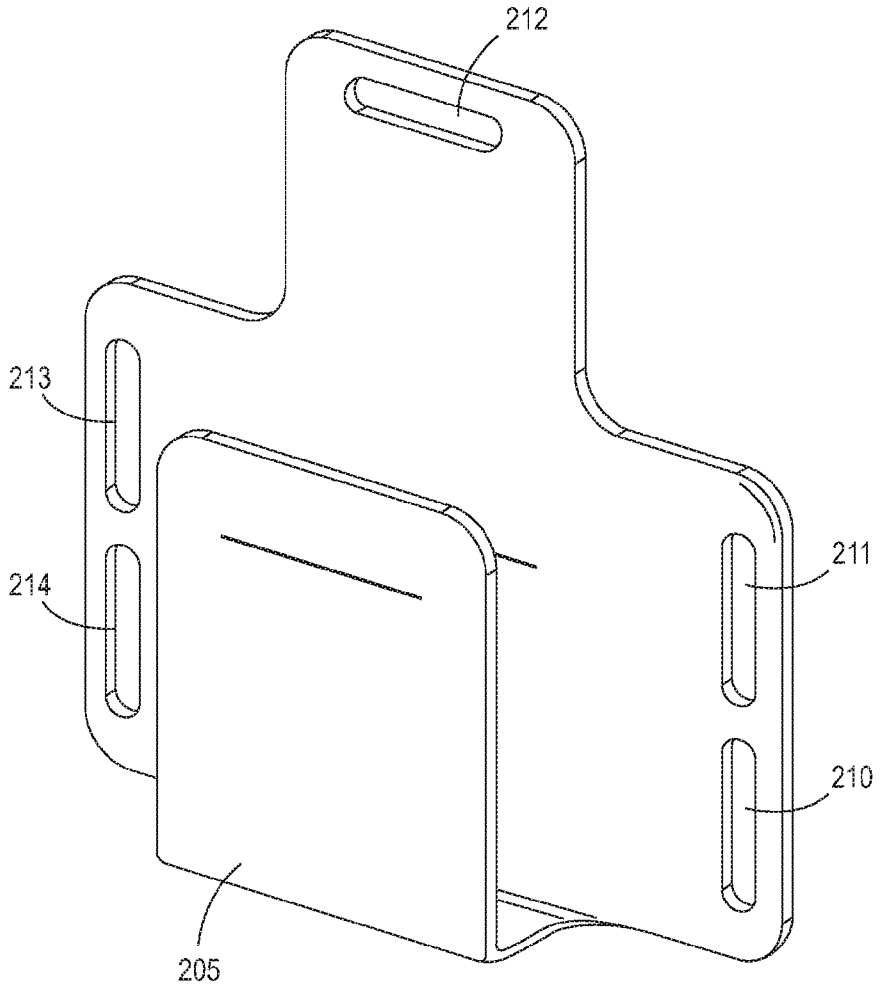
FIG. 5 is a perspective view of a holster.
Figure 6:
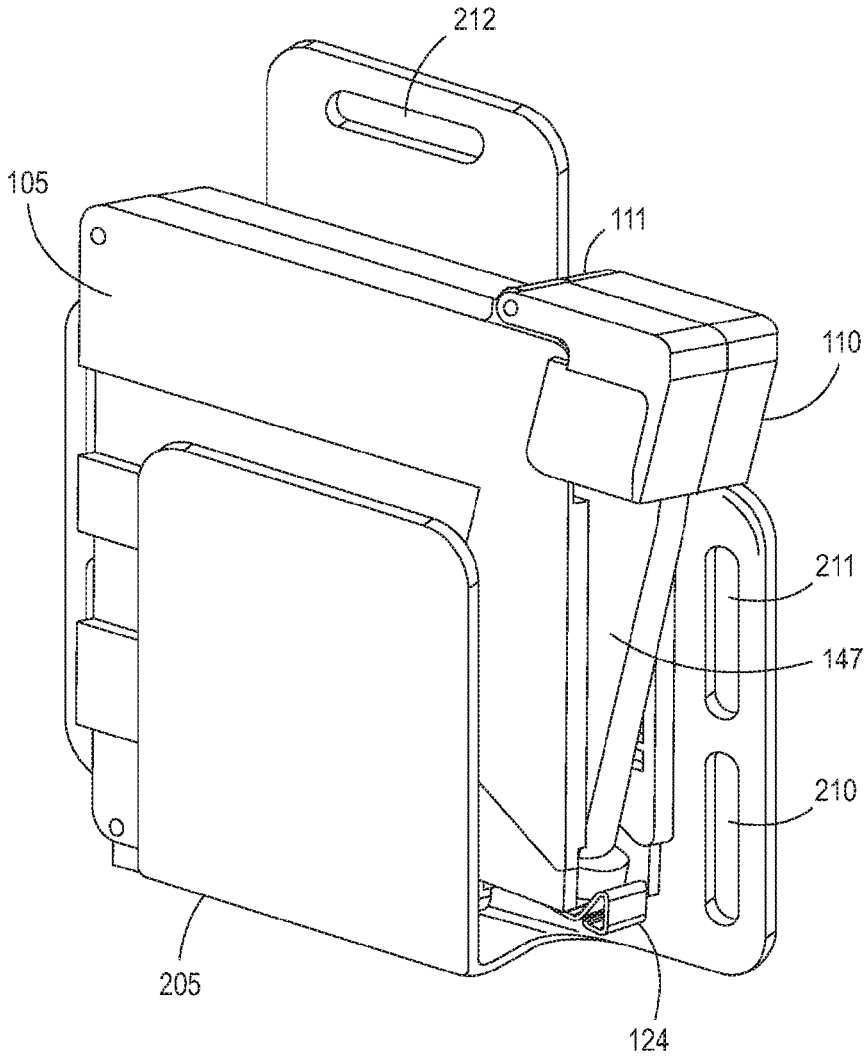
FIG. 6 is a perspective view of a magazine dispenser inserted in a holster.
Figure 7:
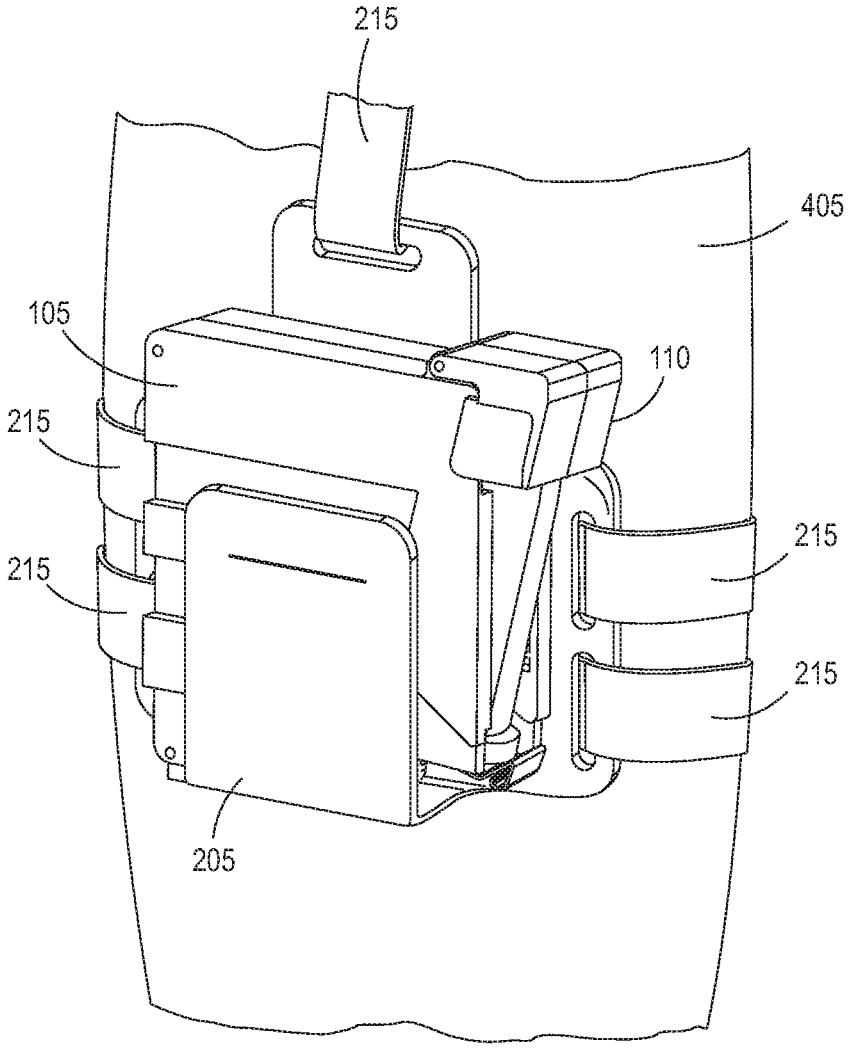
FIG. 7 is a perspective view of a magazine dispenser inserted in a holster secured on a wearer's leg.
Figure 8:
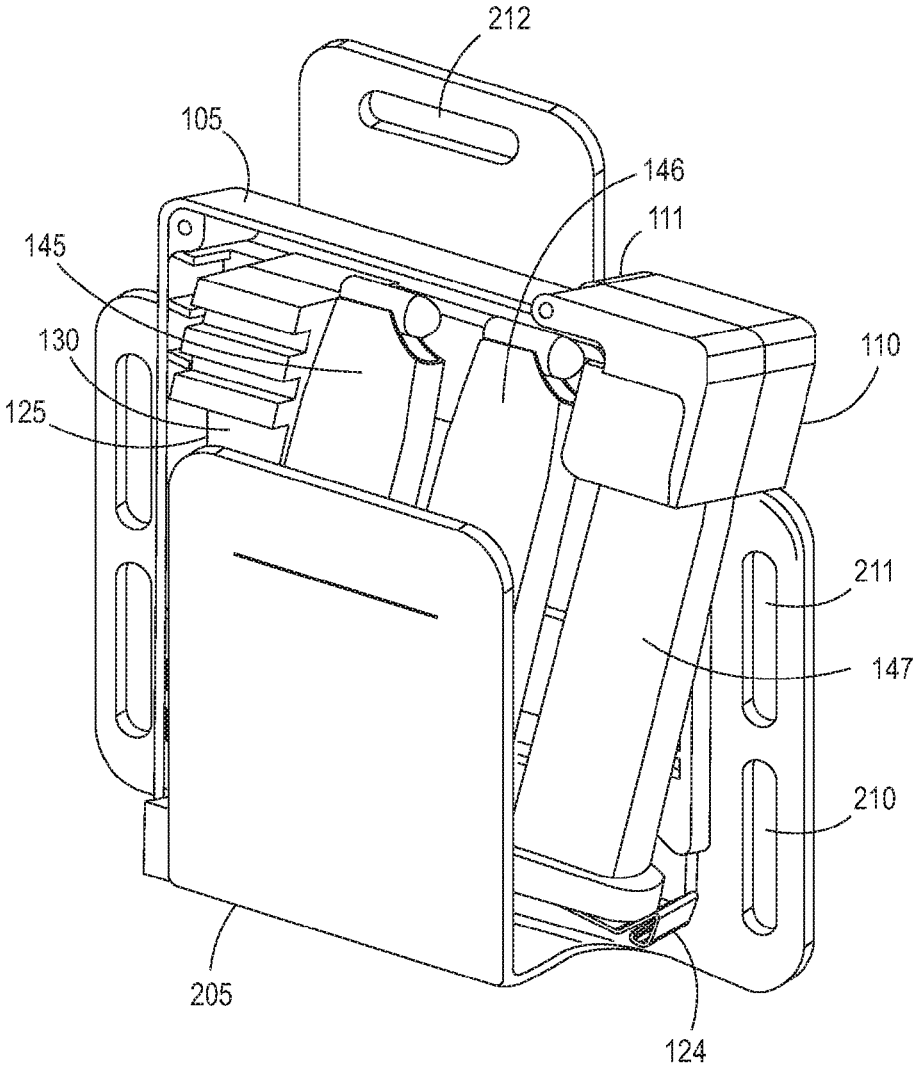
FIG. 8 is a cut away view of a magazine dispenser inserted in a holster with a cap closed.
Figure 9:
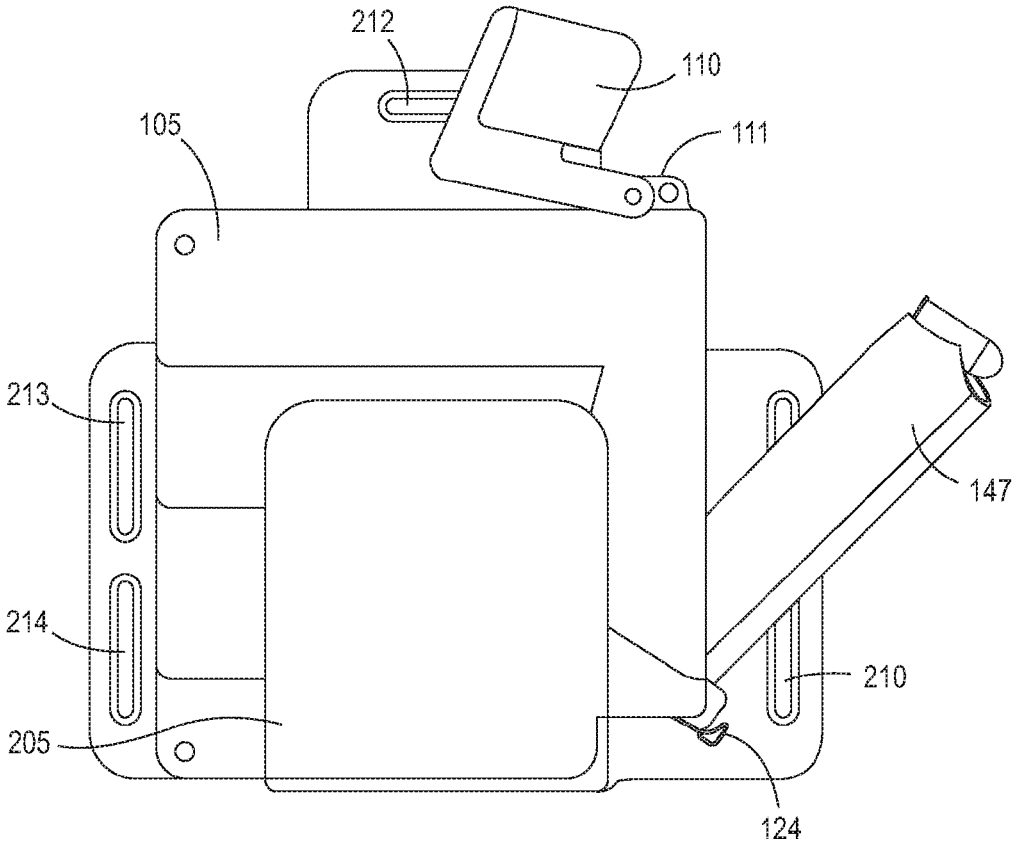
FIG. 9 is a side view of a magazine dispenser inserted in a holster with a cap opened.

Referring to FIGS. 5 and 6, the magazine dispenser may further include holster 205. As shown in FIG. 7, holster 205 may be configured to hold housing 105 and be secured to another object with strap 215. Holster 205 may include a plurality attachment holes 210-214 configured to receive strap 215 and be tightly secured to another object. For example, housing 105 may be inserted in holster 205 and be secured to wearer's leg 405 with strap 215. Strap 215 may go into one of attachment holes 210 and wrap around wearer's leg 405 to reach another attachment hole 214 in order to tightly secure holster 205 to wearer's leg 405. Referring to FIG. 8 and FIG. 9, holster 205 may be configured to not interfere with magazines being inserted or dispensed from housing 105.

As shown in FIG. 1, slot region 115 may be disposed in housing 105 and provide a track for magazines being inserted into housing 105. The track may be configured to receive a flange of a magazine. For example, a flange of the magazine may be held in the track when the magazine is inserted through the opening of housing 105.

Retention bar 120 may be disposed in the track provided by slot region 115 to bias the magazines inserted in housing 105. As shown in FIG. 2, when a magazine is inserted into housing 105, the magazine may rest on retention bar 120 and be biased according to a shape of retention bar 120. In accordance with at least one embodiment, slot region 115 may have a shape which corresponds to a shape of retention bar 120. For example, retention bar 120 may be bent to bias the magazines inserted in housing 105 at a particular angle. Then, slot region 115 may have a shape that corresponds to the bent-shape of retention bar 120. This may ensure that a flange of the magazine is tightly held regardless whether the magazine rests on either a straight or bent portion of retention bar 120.

As shown in FIG. 1, retention bar 120 may include straight portion 121, first bent portion 122, second bent portion 123, and lip portion 124. First bent portion 122 may be bent substantially perpendicular to straight portion 121. Second bent portion 123 may be bent at an acute angle with respect to first bent portion 122. For example, retention bar 120 may be a straight bar having a step and a ramp. The step may be formed by firstly bending retention bar 120 substantially perpendicular to its longitudinal axis. The ramp may be formed by secondly bending an already bent portion of retention bar 120 to an acute angle with respect to the bent portion.

As shown in FIG. 2, the magazines inserted in housing 105 may rest on retention bar 120. In accordance with at least one embodiment, housing 105 may hold three magazines. For example, first magazine 145 and second magazine 146 may be the first two magazines that are inserted in housing 105 and may rest on straight portion 121. Third magazine 147 may be a last magazine that is inserted in housing 105 and may rest on second bent portion 123. As shown in FIG. 2, first bent portion 122 may hold first two magazines, first magazine 145 and second magazine 146, from moving onto second bent portion 123, and lip portion 124 may hold a last inserted magazine, third magazine 147, from slipping out of housing 105.

Figure 10A:
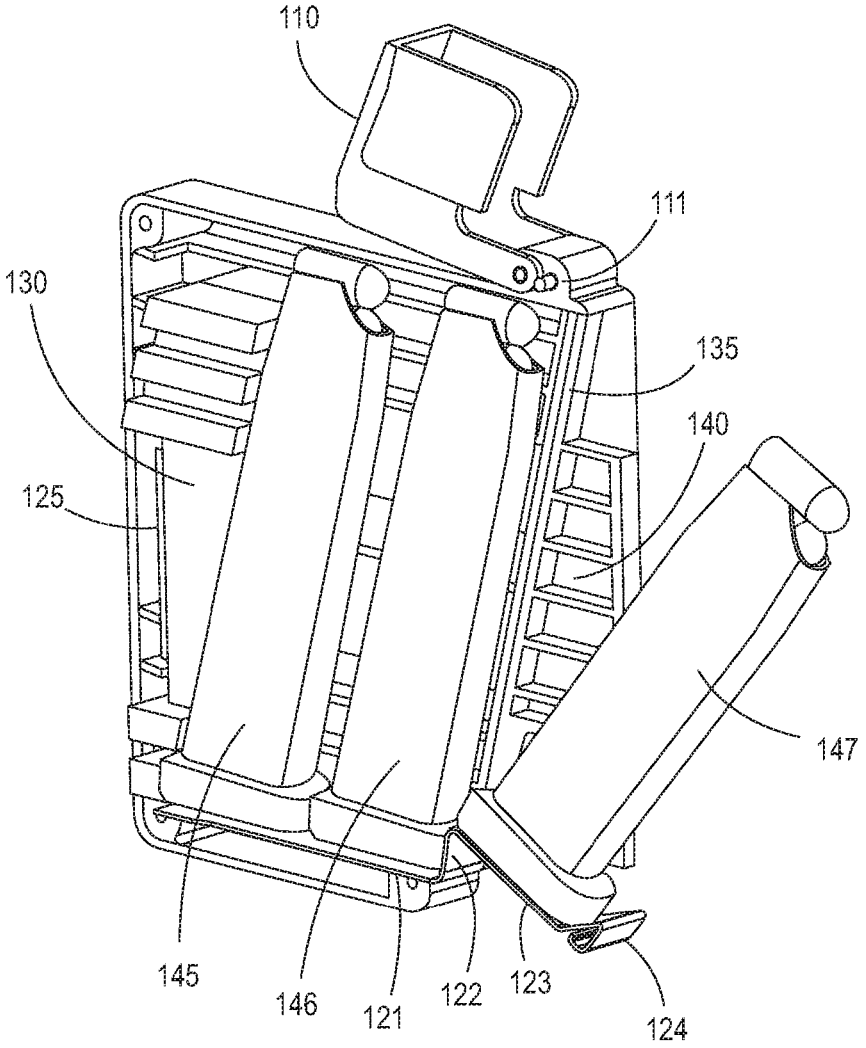
FIGS. 10A, 10B, and 10C illustrate a magazine being dispensed from a magazine dispenser.

As shown in FIG. 2, a magazine may be inserted into housing 105 in a direction which allows the magazine to be easily loaded into a gun when the magazine is dispensed from housing 105. A surface of the magazine that is being inserted through the opening of housing 105 may come into a contact with plunger 130. As shown in FIG. 10A, plunger 130 may be disposed in housing 105 and be coupled to spring 125. As shown in FIG. 10A, spring 125 may have first and second ends and be disposed between plunger 130 and an interior of housing 105. The first end of spring 125 may be coupled to plunger 130 and the second end of spring 125 may be coupled to the interior of housing 105.

As shown in FIG. 10A, plunger 130 may further have a wedge-like shape that corresponds to a shape of a magazine. For example, a surface of the magazine being inserted through the opening of housing 105 may come into contact with a surface of plunger 130. Then, a force being exerted on plunger 130 by the magazine or a force being exerted on the magazine by plunger 130 may be distributed and transferred over an area in contact. A more stable distribution or transfer of the force may occur when the area in contact is large. Accordingly, plunger 130 may have a wedge-like shape that corresponds to a shape of a magazine to increase the area in contact.

Figure 10B:
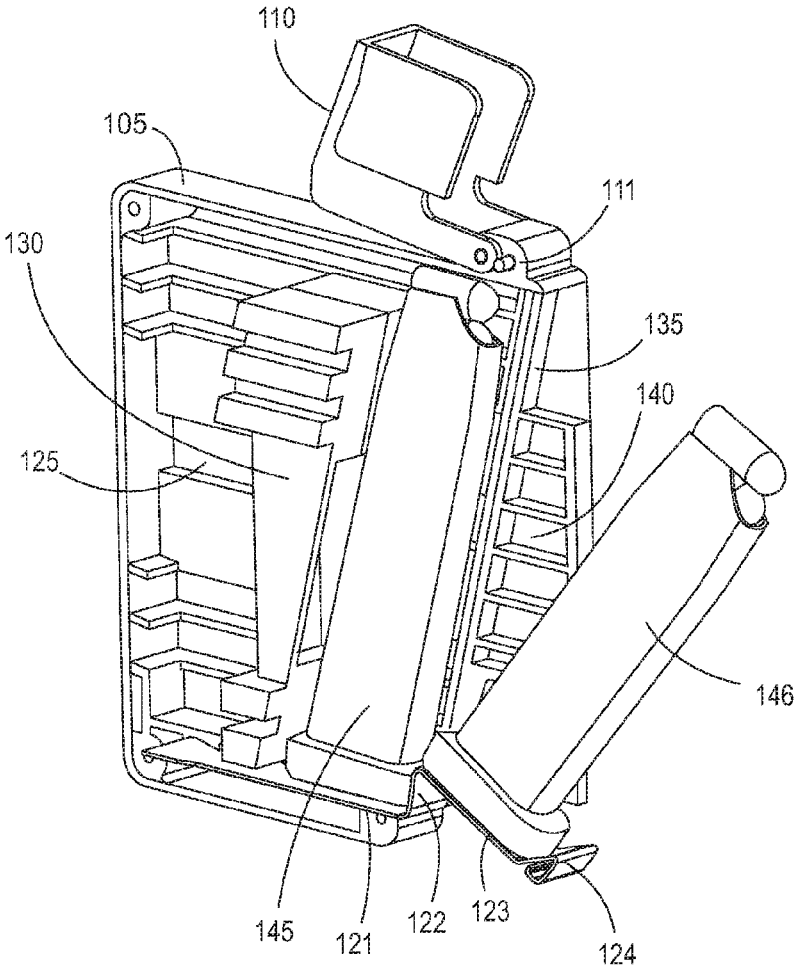
Figure 10C:
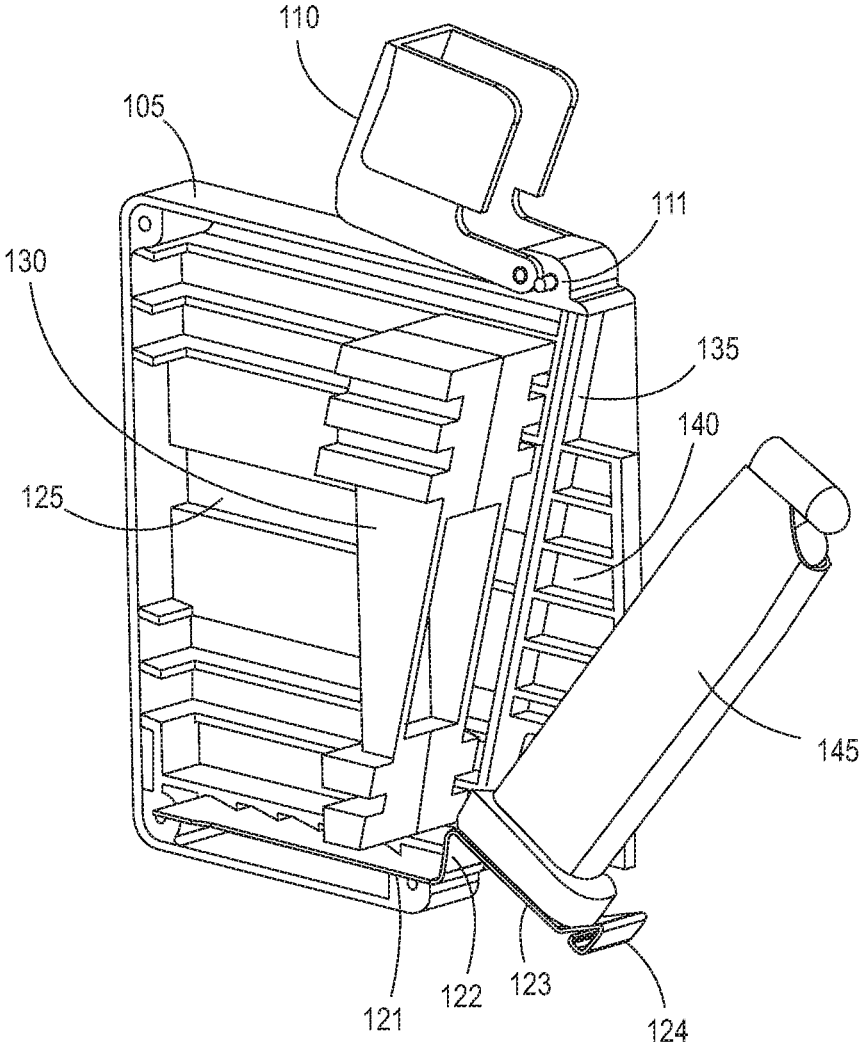

When there is only one magazine inserted in housing 105, that magazine may not come into contact with plunger 130. As shown in FIG. 10C, a magazine may reset on second bent portion 123, when there is only one magazine present in housing 105. As another magazine is inserted through the opening of housing 105, the magazine resting on second bent portion 123 may be pushed inwardly away from the opening as another magazine takes its place. The magazine may then come into contact with plunger 130. As the magazine gets pushed towards the inside of housing 105 by another magazine taking its place, the magazine may push plunger 130 away from the opening, towards the inside of housing 105 as well.

As shown in FIG. 10A, first magazine 145 may be pushed inwardly by second magazine 145, and second magazine 146 may be pushed inwardly by third magazine 147. A last inserted magazine, third magazine 147, may rest on second bent portion 123, and first two magazines 145, 146 may rest on straight portion 121. Spring 125 may be compressed and exert a tensile force against plunger 130 which is in contact with first magazine 145. First bent portion 122, however, may hold first two magazines 145, 146 from being pushed outwardly towards the opening of housing 105 by the tensile force.

Figure 11:
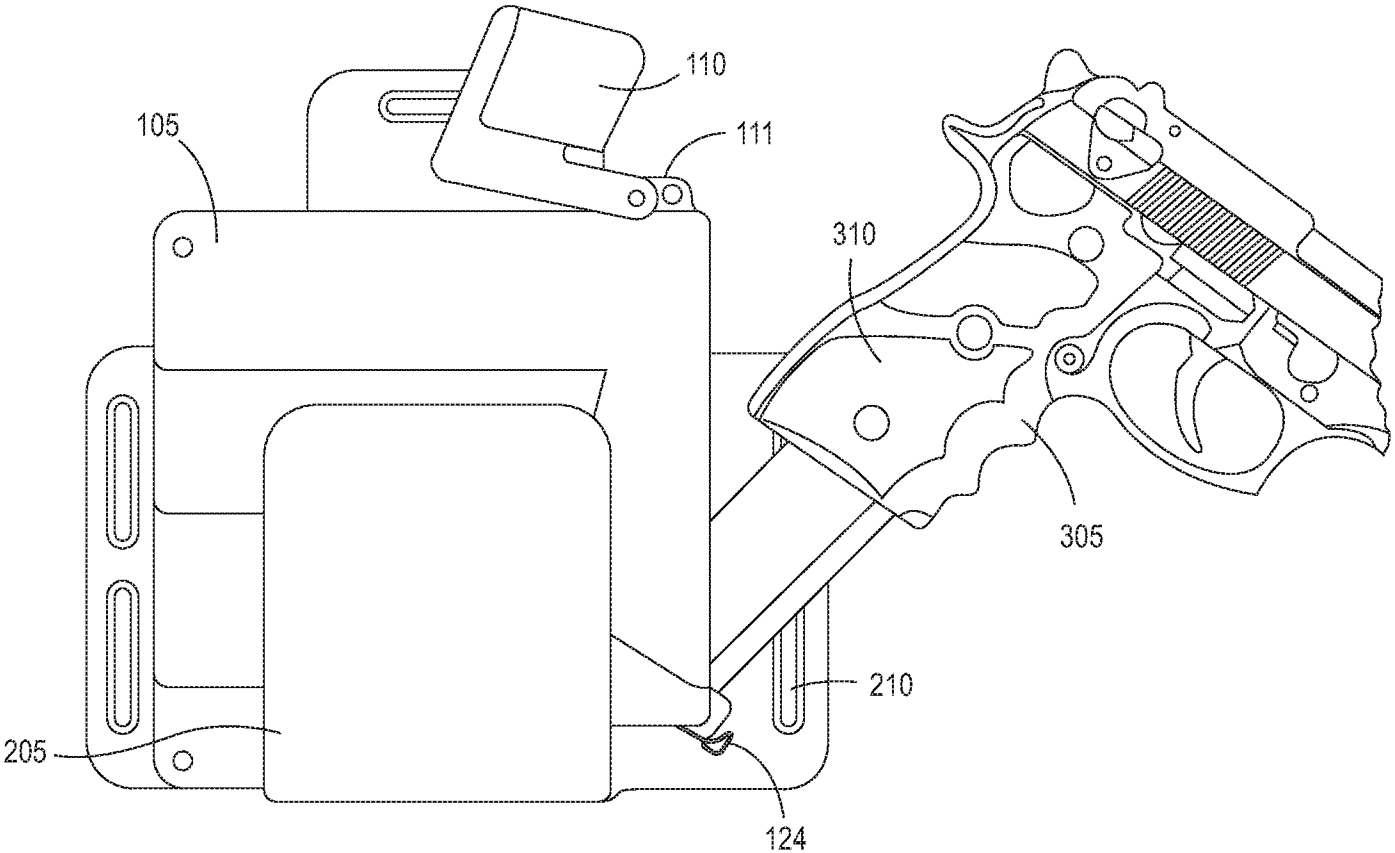
FIG. 11 illustrates a magazine being dispensed and loaded into a gun.

Thus, once spring 125 is compressed and plunger 130 is pushed inwardly, spring 125 and plunger 130 may remain still until a force is exerted on retention bar 120 to dispense a magazine resting on second bent portion 123. As shown in FIG. 11, gun 305 having magazine chamber 310 may be used to dispense a last inserted magazine, third magazine 147, resting on second bent portion 123. Once a top of third magazine 147 resting on second bent portion 123 is placed in magazine chamber 310 of gun 305, gun 305 may exert a force on retention bar 120 to have magazine 147 dispensed. Retention bar 120 may be depressed by the force and thus be flexed to allow second magazine 146 to move onto second bent portion 123, once third magazine 147 is dispensed and loaded into gun 305.

More specifically, when third magazine 147 is dispensed from housing 105 by a force exerted on retention bar 120, first bent portion 122 is flexed to allow second magazine 146 to take a place of third magazine 147. First bent portion 122 normally prevents first and second magazines 145, 146 from being pushed outwardly when it is not flexed. When first bent portion 122 is flexed, a tensile force exerted by spring 125 and plunger 130 moving outwardly due to the tensile force, pushes second magazine 146 outwardly towards the opening of housing 105 to be rested on second bent portion 123 of retention bar 120, as shown in FIG. 10B. When second magazine is dispensed from housing 105 by another force exerted on retention bar 120, first magazine 145 takes places of second magazine 146 accordingly, as shown in FIG. 10C.

Alternatively, when second magazine 146 is inserted in housing 105 after first magazine 145, first magazine 145 may push plunger 130 inwardly away from the opening of housing 105 and may compress spring 125. First magazine 145 then may rest on straight portion 121 and second magazine 146 may rest on second bent portion 123. First magazine 145 may be secured from being dispensed by first bent portion 122, unless a force is exerted to dispense second magazine 146. When the force is exerted on retention bar 120, second magazine 146 is released from second bent portion 123, and first bent portion 122 may be flexed to allow first magazine 145 to move outwardly towards the opening of housing 105. Specifically, spring 125 may exert a tensile force against plunger 130 to push first magazine 145 outwardly towards the opening of housing 105.

In accordance with at least one embodiment, the magazine dispenser may include housing 105 containing three magazines. For example, first and second magazines 145, 146 may rest on straight portion 121 and may be secured by first bent portion 122 from being pushed outwardly towards the opening of housing 105 by spring 125. Third magazine 147 may rest on second bent portion 123 and may be secured by lip portion 124, grooves 140 and closed cap 110 from being dispensed. Third magazine 147, when resting on second bent portion 123, may be resting at an angle corresponding to the angle at which second bent portion 123 is bent with respect to first bent portion 122. A top of third magazine 147 may thus protrude through the opening of housing 105, and cap 110 may be configured to cover the top of the third magazine when closed.

Although embodiments of the present disclosure have been described herein, it should be understood that the foregoing embodiments are merely examples and are not to be construed as limiting the present disclosure or the scope of the claims. Numerous other modifications and embodiments can be devised by those skilled in the art that will fall within the spirit and scope of the principles of this disclosure, and the present teaching can also be readily applied to other types of apparatuses. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments.

In addition, it should be understood that the figures and algorithms, which highlight the functionality and advantages of the present disclosure, are presented for example purposes only. The architecture of the present disclosure is sufficiently flexible and configurable, such that it may be utilized in ways other than that shown in the accompanying figures and algorithms.

It should be noted the terms "including" and "comprising" should be interpreted as meaning "including, but not limited to."

In the specification, "a" and "an" and similar phrases are to be interpreted as "at least one" and "one or more." References to "the, "said," and similar phrases should be interpreted as "the at least one", "said at least one," etc. References to "an" embodiment in this disclosure are not necessarily to the same embodiment.

It is the applicant's intent that only claims that include the express language "means for" or "step for" be interpreted under 35 U.S.C. §112, paragraph 6. Claims that do not expressly include the phrase "means for" or "step for" are not to be interpreted under 35 U.S.C. §112, paragraph 6.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

Further, the purpose of the Abstract of the Disclosure is to enable the U.S. Patent and Trademark Office and public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

What is claimed is:

1. An apparatus comprising:

a housing having an opening configured to receive at least one magazine;

a slot region in the housing configured to provide a track for the magazine;

a retention bar disposed in the slot region to bias a magazine inserted in the slot region, the retention bar comprising a straight portion, a first bent portion, and a second bent portion, and wherein the straight portion is disposed along the track and the first and second bent portions are disposed near to the opening of the housing; and a plunger disposed in the housing and coupled to an interior of the housing.

2. The apparatus of claim 1 further comprising a holster which surrounds an exterior of the housing and includes attachment holes.

3. The apparatus of claim 2, wherein the spring is compressed when the plunger is pushed inwardly away from the opening of the housing, and wherein the spring exerts a force against the plunger when compressed.

4. The apparatus of claim 1 further comprising brushes near the opening of the housing, and wherein the brushes prevent external dust from coming into the housing.

5. The apparatus of claim 1 further comprising grooves near the opening of the housing, and wherein the grooves provide a grip for a magazine inserted in the housing.

6. The apparatus of claim 1 further comprising a spring having first and second ends, wherein the spring is disposed between the plunger and the interior of the housing.

7. The apparatus of claim 6, wherein the first end of the spring is coupled to the interior of the housing and the second end of the spring is coupled to the plunger.

8. The apparatus of claim 6, wherein the plunger is pushed toward the interior of the housing when the magazine is inserted into the housing.

9. The apparatus of claim 1, wherein the track is configured to receive a flange of the magazine.

10. The apparatus of claim 9, wherein the track holds a flange of the magazine when the magazine is inserted in the housing.

11. The apparatus of claim 1, wherein the straight portion is disposed along the track, and wherein magazines rest on the straight portion when there are at least two magazines inserted in the housing.

12. The apparatus of claim 1, wherein the first bent portion is bent substantially perpendicular to a longitudinal axis of the straight portion, and wherein the first bent portion prevents magazines inserted in the housing from being dispensed.

13. The apparatus of claim 1, wherein the second bent portion is bent at an acute angle with respect to the first bent portion, and wherein a last inserted magazine rests on the second bent portion.

14. The apparatus of claim 13, wherein a top end of the last inserted magazine resting on the second bent portion protrudes through the opening of the housing.

15. The apparatus of claim 14, wherein the first bent portion is flexed to allow a magazine resting on the straight portion to move to the second bent portion when the last inserted magazine is dispensed from the housing.

16. The apparatus of claim 15, wherein the first bent portion of the retention bar is bent substantially perpendicular to a longitudinal axis of the straight portion.

17. The apparatus of claim 15, wherein the second portion of the retention bar is bent at an acute angle with respect to the first bent portion.

18. The apparatus of claim 15, wherein first and second magazines rest on the straight portion of the retention bar and a third magazine rests on the second bent portion, when three magazines are inserted in the housing.

19. The apparatus of claim 1, wherein the retention bar is flexed when a force is exerted to dispense a last inserted magazine resting on the second bent portion.

20. The apparatus of claim 1 further comprising a cap pivotally coupled to an exterior of the housing with a securing means.

21. The apparatus of claim 20, wherein the cap has open and closed positions, wherein the closed position keeps a last inserted magazine resting on the retention bar in the housing, and wherein the open position allows the last magazine to be dispensed.

22. An apparatus for dispensing a magazine, the apparatus comprising:

a) a housing comprising opposed first and second side walls joined to a back wall, a bottom wall, and a top wall, each of the first and second side walls, top wall, and bottom wall including a front edge wherein the front edges of the walls define a front opening of the housing; and b) an elongated bar disposed between the opposed first and second side walls and comprising a base section proximate to the bottom wall, a step section formed between a first bend at an end of the base section and a second bend; and a ramp section extending from the second bend out the front opening of the housing and terminating at a lip.

23. The apparatus of claim 22, further comprising a plunger assembly comprising a plunger member disposed between the first and second side walls of the housing and movable along an axis from the back wall toward the housing front opening and parallel to the bottom wall, and a spring in compression and engaged with the back wall and the plunger member.

24. The apparatus of claim 22, wherein the first and second opposed side walls include elongated opposed slots proximate to the bottom wall and extending in a direction from the back wall toward the front opening.

25. The apparatus of claim 24, wherein the elongated slot of the first side wall and the elongated slot of the second side wall are shaped to correspond to the base section, step section, and ramp section of the elongated bar.

26. The apparatus of claim 25, wherein:

the apparatus is further comprised of a plunger assembly comprising a plunger member disposed between the first and second side walls of the housing and movable along an axis from the back wall toward the housing front opening and parallel to the bottom wall, and a spring in compression and engaged with the back wall and the plunger member; and the magazine is comprised of an elongated hollow body having an open proximal end and a distal end, and a base flange joined to the distal end of the body and including opposed protruding flange edges, and wherein the magazine is disposable within the housing with the opposed protruding flange edges slidably engaged with the elongated slot of the first side wall and the elongated slot of the second side wall and with the plunger member in contact with the elongated hollow body of the magazine.

27. The apparatus of claim 26, wherein the magazine is a first magazine, and is slidably displaceable along the retention bar within the housing toward the back wall by disposing a second magazine at least partially within the housing.

28. The apparatus of claim 22, further comprising a cap pivotably joined to a top front region of the housing, and pivotable from an open position above the front opening of the housing to a closed position obstructing a portion of the front opening of the housing.

29. The apparatus of claim 28, wherein the magazine is comprised of an elongated hollow body having an open proximal end and a distal end, and a base flange joined to the distal end of the body and disposable upon the ramp section of the elongated bar, and wherein the cap is engageable with the open proximal end of the hollow body of the magazine when the cap is in the closed position.

30. The apparatus of claim 22, wherein the retention bar is formed of an elastic material, and wherein application of a force perpendicular to the ramp section of the elongated bar causes downward displacement of the ramp section relative to the housing from a free position to a stressed position, and wherein removal of the force causes restoration of the ramp section to the free position.

31. A magazine dispenser comprising:

a) a housing comprising opposed first and second side walls joined to a bottom wall and a top wall, each of the first and second side walls, top wall, and bottom wall including a front edge wherein the front edges of the walls define a front opening of the housing;

b) an elongated bar disposed between the opposed first and second side walls and comprising a base section proximate to the bottom wall, a step section formed between a first bend at an end of the base section and a second bend; and a ramp section extending from the second bend out the front opening of the housing and terminating at a lip; and c) a first magazine comprised of an elongated hollow body having an open proximal end and a distal end, and a base flange joined to the distal end of the body and comprised of a bottom surface in slidable contact with the retention bar.

32. The dispenser of claim 31, wherein the base flange of the magazine is disposed upon the ramp section of the elongated bar.

33. The dispenser of claim 32, further comprising a cap pivotably joined to a top front region of the housing, and pivotable from an open position above the front opening of the housing to a closed position obstructing a portion of the front opening of the housing and engaged with the open proximal end of the hollow body of the magazine.

34. The dispenser of claim 31, wherein:

the dispenser is further comprised of a plunger assembly comprising a plunger member disposed between the first and second side walls of the housing and movable along an axis from the back wall toward the housing front opening and parallel to the bottom wall, and a spring in compression and engaged with the back wall and the plunger member; and the bottom surface of the base flange of the first magazine is in slidable contact with the base section of the retention bar and the hollow body of the first magazine is in contact with the plunger member, and the dispenser is comprised of a second magazine comprising an elongated hollow body having an open proximal end and a distal end, and a base flange joined to the distal end of the body of the second magazine and comprised of a bottom surface disposed upon the ramp section of the elongated bar.

35. The dispenser of claim 34, wherein the first and second opposed side walls of the housing include elongated opposed slots proximate to the bottom wall, extending in a direction from the back wall toward the front opening, and shaped to correspond to the base section, step section, and ramp section of the elongated bar, and wherein the base flange of the first magazine is comprised of opposed protruding flange edges slidably engaged with the elongated opposed slots of the first and second opposed side walls.

36. The dispenser of claim 35, wherein the retention bar is formed of an elastic material, and wherein application of a force by the base flange of the second magazine against the ramp section of the elongated bar causes downward displacement of the ramp section and forward displacement of an upper region of the step section of the bar; the forward displacement of the upper region of the step section of the bar enabling the displacement force on the plunger member to cause the plunger member to slide within the housing and cause the base of the first magazine to slide upwardly over the step section; and wherein removal of a force by the base flange of the second magazine against the ramp section of the elongated bar and removal of the second magazine from the housing causes restoration of the ramp section to the free position and permits the first magazine to move to a position wherein the base flange of the first magazine is disposed upon the ramp section of the elongated bar.

* * * * *